US007404394B2

(12) United States Patent
Mai et al.

(10) Patent No.: US 7,404,394 B2
(45) Date of Patent: Jul. 29, 2008

(54) METHOD AND DEVICE FOR OPERATING AN INTERNAL COMBUSTION ENGINE

(75) Inventors: Wolfgang Mai, Eschborn (DE); Jens Pache, Kelkheim (DE); Matthias Wiese, Frankfurt am Main (DE)

(73) Assignee: Siemens Aktiengesellschaft, Munich (DE)

( * ) Notice: Subject to any disclaimer, the term of this patent is extended or adjusted under 35 U.S.C. 154(b) by 15 days.

(21) Appl. No.: 11/655,959

(22) Filed: Jan. 19, 2007

(65) Prior Publication Data

US 2007/0163550 A1 Jul. 19, 2007

(30) Foreign Application Priority Data

Jan. 19, 2006 (DE) ..... 10 2006 002 718

(51) Int. Cl.
*F02M 33/02* (2006.01)

(52) U.S. Cl. ..... 123/520

(58) Field of Classification Search ..... 123/516, 123/518–520

See application file for complete search history.

(56) References Cited

U.S. PATENT DOCUMENTS 5,183,023 A * 2/1993 Hanson ..... 123/520
5,190,015 A * 3/1993 Nakata et al. ..... 123/520
5,220,898 A * 6/1993 Kidokoro et al. ..... 123/520
5,371,412 A * 12/1994 Iwashita et al. ..... 290/1 R
5,533,479 A * 7/1996 Wild et al. ..... 123/520
5,918,580 A * 7/1999 Hennrich et al. ..... 123/520
6,234,156 B1 5/2001 Muto
6,305,360 B1 * 10/2001 Hurley ..... 123/520
6,446,618 B1 * 9/2002 Hill ..... 123/698
6,698,402 B2 * 3/2004 Biesinger et al. ..... 123/520
6,729,311 B2 * 5/2004 Auernhammer et al. ..... 123/519
6,772,740 B2 * 8/2004 Kojima et al. ..... 123/519
7,044,118 B2 * 5/2006 Tonetti et al. ..... 123/674
7,146,970 B2 * 12/2006 Everingham et al. ..... 123/520
2003/0000505 A1 * 1/2003 Auernhammer et al. ..... 123/520

FOREIGN PATENT DOCUMENTS

DE 699 18 914 T2 7/2005
DE 10 2004 021 387 A1 11/2005

* cited by examiner

*Primary Examiner*—Thomas N Moulis

(57) ABSTRACT

An internal combustion engine has an intake duct, which opens into at least one inlet of at least one cylinder. It also has a tank purging valve, which is configured to control the initiation of a tank purging flow into the intake duct at an inlet point upstream of the respective inlet of the respective cylinder. A main path is configured in the intake duct and a recirculation path is configured there with a recirculation control element, a recirculation inlet from the main path into the recirculation path and a recirculation outlet from the recirculation path into the main path. The recirculation outlet is disposed in the main path upstream in relation to the recirculation inlet. A cylinder tank purging fuel mass is determined as a function of an opening angle of the tank purging valve and an opening angle of the recirculation control element.

12 Claims, 3 Drawing Sheets

METHOD AND DEVICE FOR OPERATING AN INTERNAL COMBUSTION ENGINE

CROSS REFERENCE TO RELATED APPLICATIONS

This application claims priority of German application No. 10 2006 002 718.3 filed Jan. 19, 2006, which is incorporated by reference herein in its entirety.

FIELD OF INVENTION

The invention relates to a method and device for operating an internal combustion engine.

BACKGROUND OF THE INVENTION

The performance and efficiency of internal combustion engines are subject to increasingly exacting requirements. At the same time stringent legal provisions require pollutant emissions to be kept low.

Internal combustion engines are therefore regularly fitted with tank purging devices, by means of which fuel evaporation emissions from a tank in a vehicle, in which the internal combustion engine can be disposed, are buffered in an active carbon holder. A tank purging valve is used at regular intervals to regenerate the active carbon filter. The tank purging valve thereby releases a connection to the intake duct of the internal combustion engine. The fuel bound in the active carbon holder can thus flow into the intake duct of the internal combustion engine and be combusted in the respective cylinder of the internal combustion engine. For precise operation of the internal combustion engine with low emissions, it is essential that such additionally incorporated fuel is also taken into accurate account.

Internal combustion engines are also known, wherein a compressor is disposed in the intake duct to compress the air flowing in the intake duct on its way to the respective combustion chamber of the respective cylinder. With such compressors it is possible in particular to increase the output of the internal combustion engine, on the one hand achieving a better overall performance or reducing displacement and therefore the overall weight of the internal combustion engine for the same output compared with those without a corresponding compressor. This allows what is known as downsizing.

SUMMARY OF INVENTION

The object of the invention is to create a method and device, which allow precise operation of an internal combustion engine.

The object is achieved by the features of the independent claims. Advantageous embodiments of the invention are characterized in the subclaims.

The invention is characterized by a method and a corresponding device for operating an internal combustion engine with an intake duct, which opens into at least one inlet of at least one cylinder. The internal combustion engine is also assigned a tank purging valve, which is configured to control the initiation of a tank purging flow into the intake duct at an inlet point upstream of the respective inlet of the respective cylinder. A main path is configured in the intake duct. A recirculation path is also configured in the intake duct, with a recirculation control element, a recirculation inlet from the main path into the recirculation path and a recirculation outlet from the recirculation path into the main path. The recirculation outlet is disposed in the main path upstream in relation to the recirculation inlet. The recirculation path is disposed such that fluid from the recirculation inlet flows toward the recirculation outlet as a function of an opening angle of the recirculation control element during operation of the internal combustion engine. The recirculation path is preferably configured for example as a bypass to a compressor.

A cylinder tank purging fuel mass is determined, which flows into a cylinder during the working cycle of the respective cylinder of relevance to a previous measuring in of fuel. The cylinder tank purging fuel mass is determined as a function of an opening angle of the tank purging valve and an opening angle of the recirculation control element. This makes use of the knowledge that the changing opening angle of the recirculation control element has a not insignificant effect on the cylinder tank purging fuel mass and therefore by taking into account the opening angle of the recirculation control element it is possible to determine the cylinder tank purging fuel mass very precisely. It is thus possible to prevent unwanted hydrocarbon emissions.

According to an advantageous embodiment of the method a dynamic physical model of the recirculation path is used to determine the cylinder tank purging fuel mass. It is thus possible to determine the cylinder tank purging fuel mass particularly precisely even very close in time to changes in the opening angle of the recirculation control element.

According to a further advantageous embodiment the dynamic physical model of the recirculation path comprises a recirculation ring store for recirculation tank purging values of a characteristic quantity, which is representative of a tank purging fuel mass, which flows into the recirculation ring store on the inlet side in each instance during a predetermined time period. The recirculation tank purging values are determined for storage in the recirculation ring store as a function of at least the opening angle of the recirculation control element and as a function of an output main path tank purging value, which is representative of a tank purging fuel mass, which flows toward the recirculation inlet in the main path in each instance during the predetermined time period. A recirculation tank purging value flowing through the recirculation outlet is determined as a function of the opening angle of the recirculation control element from the recirculation ring store. It is thus possible to take a dead time of the recirculation path into account in a very simple and yet precise manner.

BRIEF DESCRIPTION OF THE DRAWINGS

Exemplary embodiments of the invention are described in more detail below with reference to the schematic drawings, in which.

Elements of identical structure or function are shown with the same reference characters in all the figures.

DETAILED DESCRIPTION OF INVENTION

Figure 1:
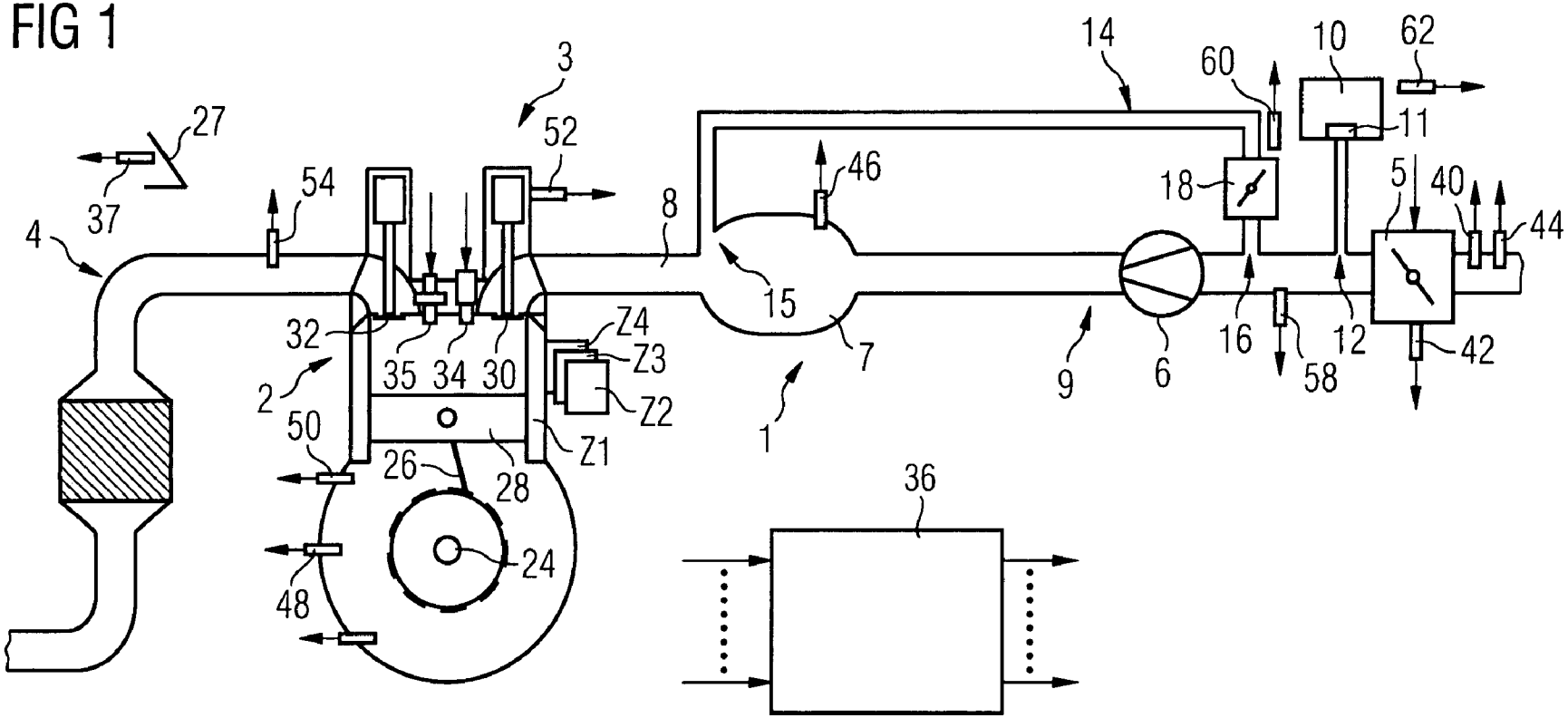
FIG. 1 shows an internal combustion engine with a control device.

An internal combustion engine (FIG. 1) comprises an intake duct 1, an engine block 2, a cylinder head 3 and an exhaust gas duct 4. A throttle valve 5 is disposed in the intake duct 4 and a compressor 6 is also disposed in the intake duct 1. The intake duct also comprises a manifold 7 and an intake pipe 8, running from the manifold 7 to a respective inlet of a respective cylinder Z1 to Z4. A main path 9 of the intake duct comprises those components, through which fluid from the tank purging valve 11 flows by way of the compressor 6 to the inlet of the respective cylinder. The intake duct 1 also comprises a recirculation path 14, which extends from a recirculation inlet 15 from the main path 9 to a recirculation outlet 16 into the main path 9. A recirculation control element 18 is disposed in the recirculation path 14, with fluid being able to flow through the recirculation path 14 from the recirculation inlet 15 toward the recirculation outlet 16 as a function of the opening angle of said recirculation control element 18.

The respective intake pipe 8 runs toward the cylinder Z1 by way of the inlet channel into the engine block 2. The engine block 2 also comprises a crankshaft 24, which is coupled by way of a connecting rod 26 to the piston 28 of the cylinder Z1. The cylinder head 3 comprises a valve train with a gas inlet valve 30 and a gas outlet valve 32 and respectively assigned valve drives.

The cylinder head 3 further comprises an injection valve 34 and a spark plug 35. Alternatively the injection valve 34 can also be disposed in the intake pipe 8.

The tank purging device 10 is configured to buffer fuel vapors from a tank system of the internal combustion engine in a store, which is preferably configured as an active carbon filter, and then to regenerate the store again in appropriate operating situations of the internal combustion engine. With the tank purging valve 29 in the open position, a tank purging flow enriched with fuel can flow from the tank purging device 10 into the intake duct 1 by way of the inlet point 12. With the tank purging valve in the closed position there is no tank purging flow into the intake duct 1. In an alternative embodiment of the internal combustion engine there may for example be no throttle valve present either. In this instance —but also when the throttle valve 5 is present— the inlet point 12 can open into the intake duct at any point, where there is suitable pressure during operation of the internal combustion engine to ensure that the tank purging flow flows away into the intake duct and which is disposed upstream of the outlet 16 in the main flow direction in the main path. A region close by and downstream of an air filter for example is possible for this purpose.

A control device 36 is also provided, to which sensors are assigned, which capture different measured variables and determine the value of the measured variable in each instance. Operating variables capture the measured variables and variables derived therefrom. The control device 36 determines manipulated variables as a function of at least one of the operating variables, said manipulated variables then being converted to one or more actuating signals to control the control elements by means of corresponding actuating drives. The control device 36 can also be referred to as a device for operating or controlling the internal combustion engine.

The sensors are a pedal position sensor 36, which captures the position of a gas pedal 38, an air mass sensor 40, which captures an air mass flow upstream of the throttle valve 5, a throttle valve position sensor 42, which captures an opening angle of the throttle valve 5, a first temperature sensor 44, which captures an intake air temperature, an intake pipe pressure sensor 46, which captures an intake pipe pressure MAP in the manifold 6, a crankshaft angle sensor 48, which captures a crankshaft angle, to which a rotation speed is then assigned. A second temperature sensor 50 captures a coolant temperature. An exhaust gas probe 54 is also preferably provided, to capture the residual oxygen content of the exhaust gas, with a measurement signal that is characteristic of the air/fuel ratio in the cylinder Z1. A further pressure sensor 58 can also be present, to capture the pressure in the main path 9 downstream of the throttle valve 5 and upstream of the compressor 6, which can also be referred to as a further intake pipe pressure. Position sensors 60, 62 are also preferably present to capture the opening angle of the tank purging valve 11 or the recirculation control element 18.

Depending on the embodiment of the invention, it is possible for any subset of said sensors to be present or additional sensors may also be present.

For example, instead of the position sensor 60 to capture the opening angle of the tank purging valve 11, the opening angle can also be determined as a function of an actuating signal, applied to the tank purging valve, optionally also taking into account at least one further operating variable.

The control elements are for example the throttle valve 5, the gas inlet and gas outlet valves 30, 32, the injection valve 34, the spark plug 35, the tank purging valve 11 or the recirculation control element 18.

In addition to the cylinder Z1 further cylinders Z2 to Z4 are preferably also provided, to which corresponding control elements and optionally sensors are also assigned.

Figure 2:
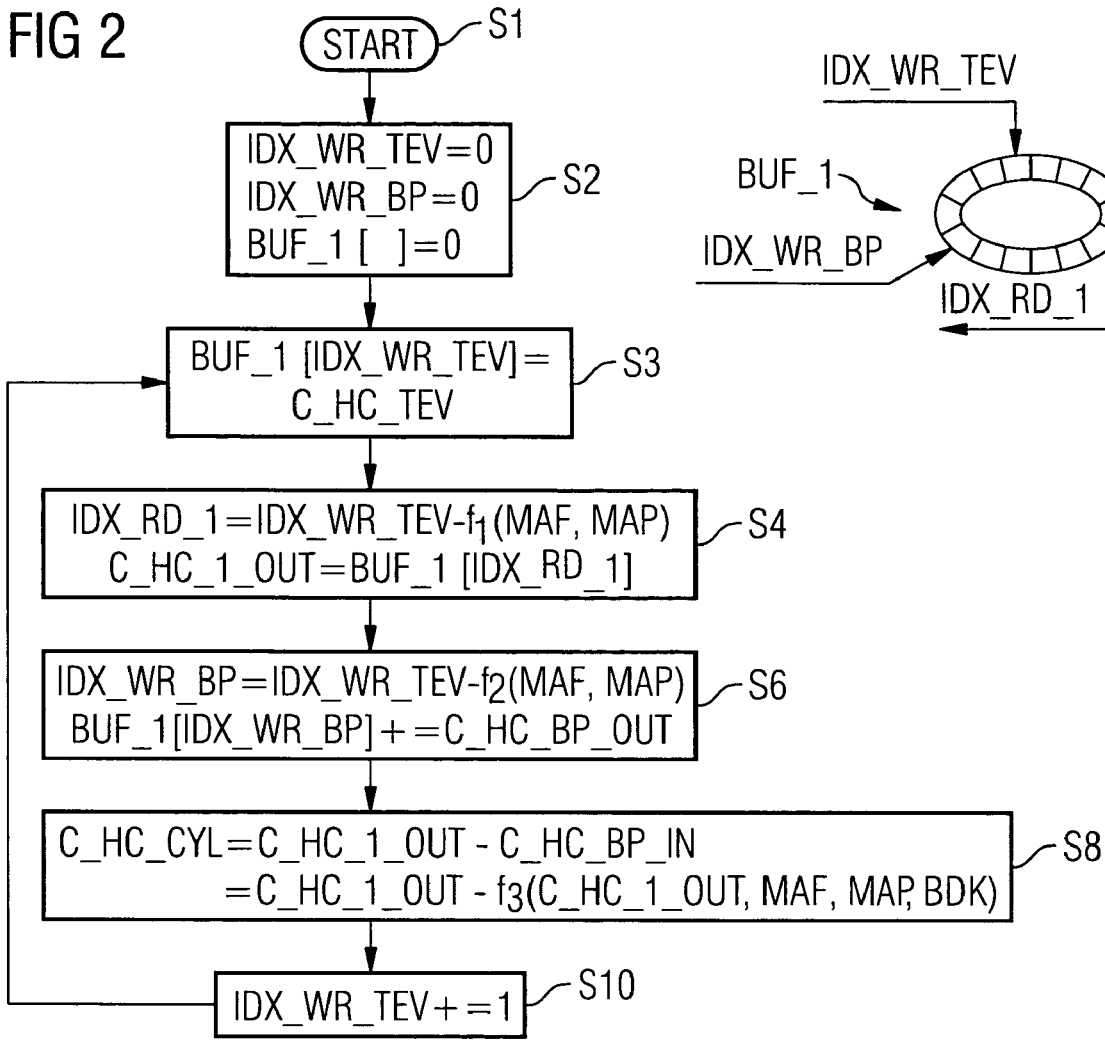
FIG. 2 shows a flow diagram of a first program, which is processed in the control device.
Figure 4:
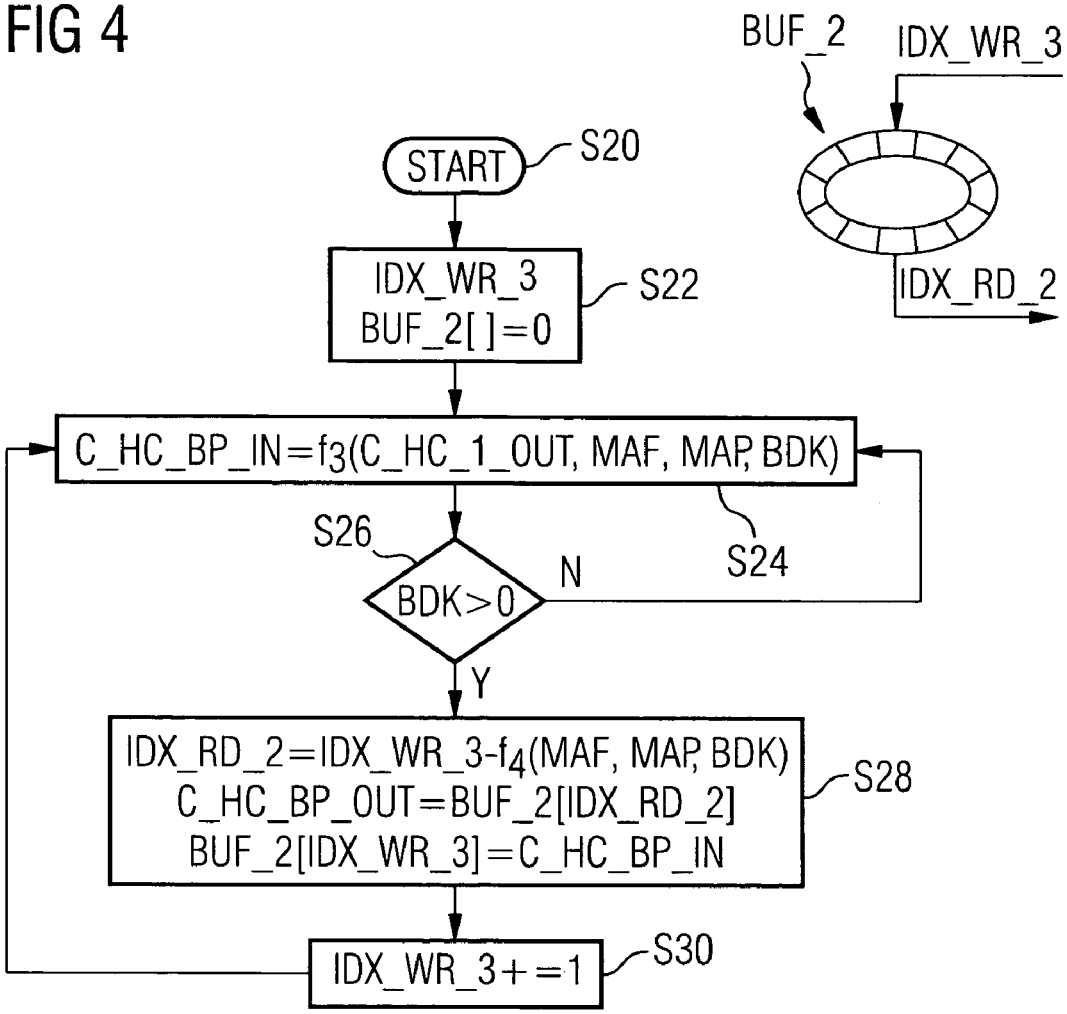
FIG. 4 shows a flow diagram of a third program, which is processed in the control device.

The program according to the flow diagram in FIG. 4 is processed during operation of the internal combustion engine. The program in FIG. 2 is used to produce a dynamic physical model of the main path of the internal combustion engine, incorporating a dynamic physical model of the recirculation path 14, as described in more detail below with reference to the flow diagram in FIG. 4.

A main path ring store BUF_1 is provided. The program is started in a step S1. Variables are initialized in a step S2. Thus in step S2 a first write pointer IDX_WR_TEV, a second write pointer IDX_WR_BP and the storage range of the main path ring store BUF_1 are initialized, preferably with zero values.

In a step S3 an input main path tank purging value C_HC_TEV is determined, of a characteristic quantity that is representative of a tank purging fuel mass, which flows from the tank purging valve 11 into the main path 9 in each instance during the predetermined time period. The characteristic quantity is preferably a fuel concentration in relation to the air mass flowing in during the time period, which also incorporates the fuel. This can preferably be determined using a corresponding physical model of the tank purging system. To this end a concentration of fuel vapors in the tank for example can be determined as an estimated value and the input main path tank purging value C_HC_TEV can then be determined as a function of the opening angle of the tank purging valve 11. The air mass flowing in by way of the throttle valve 5 is then also taken into account. The characteristic quantity can also be the absolute tank purging fuel mass directly.

The same also applies to the characteristic quantities disclosed below.

In step S3 the input main path tank purging value C_HC_TEV is then also buffered at the storage point of the main path ring store BUF_1, to which the first write pointer IDX_WR_TEV points.

In a step S4 the value of the first write pointer IDX_WR_TEV minus a function value is assigned to a first read pointer IDX_RD_1, said function value being determined by means of a first function $f_1$ as a function of the air mass flow MAF into the intake duct 1 and the intake pipe pressure MAP. The first function can for example also comprise one or more characteristic maps and is preferably determined beforehand by experimentation or simulation, such that a suitable value is assigned to the first read pointer IDX_RD_1 by means of the formula in step S4, to read an output main path tank purging value C_HC_1_OUT of the characteristic quantity from the main path ring store BUF_1, which is representative of the tank purging fuel mass, which flows in the main path upstream of the recirculation inlet 15 and in the region of the recirculation inlet 15 of the branch point in each instance during the predetermined time period.

In step S4 the output main path tank purging value C_HC_1_OUT is determined from the main path ring store BUF_1 as a function of the position of the first read pointer IDX_RD_1.

In a step S6 the value of the first write pointer IDX_WR_TEV minus a value, which is determined by means of a second function $f_2$ as a function of the air mass flow MAF into the intake duct 1 and the intake pipe pressure MAP, is assigned to the second write pointer IDX_WR_BP. The second function $f_2$ is determined correspondingly by experimentation on an engine test bed or by simulation, such that it models a gas runtime from the tank purging valve 11 to the recirculation outlet 16 in the main path 9.

In step S6 a recirculation tank purging value C_HC_BP_OUT flowing through the recirculation outlet 16 during the predetermined time period is then added to the storage point predetermined in the main path ring store by the position of the second write pointer IDX_WR_BP, having been determined by means of the program according to FIG. 4. This couples the physical model of the recirculation path 14 to the physical model of the main path 9.

In a step S8 a cylinder tank purging value C_HC_CYL is determined for a characteristic quantity, which is representative of a tank purging fuel mass, which flows into the respective cylinder or into the respective combustion chamber of the respective cylinder Z1 to Z4 in each instance during the predetermined time period. This is done by forming the difference between the output main path tank purging value C_HC_1_OUT and a recirculation tank purging value C_HC_BP_IN of a characteristic quantity, which is representative of a tank purging fuel mass, which flows into the recirculation path 14 on the inlet side in each instance during the predetermined time period.

The recirculation tank purging value C_HC_BP_IN is [lacuna] by means of a third function $f_3$, as a function of the output main path tank purging value C_HC_1_OUT, the air mass flow MAF, the intake pipe pressure MAP and the opening angle BDK of the recirculation control element 18. The third function $f_3$ is determined correspondingly by means of experimentation on an engine test bed or by simulation.

In a step S10 the first write pointer IDX_WR_TEV is incremented, preferably by the value one. After step S10 processing continues, in some instances after a predetermined waiting period. The waiting period is in particular predetermined such that steps S3 to S10 are carried out once for each predetermined time period, with the capture times of the respective measured variables being of relevance to this consideration.

Figure 3:
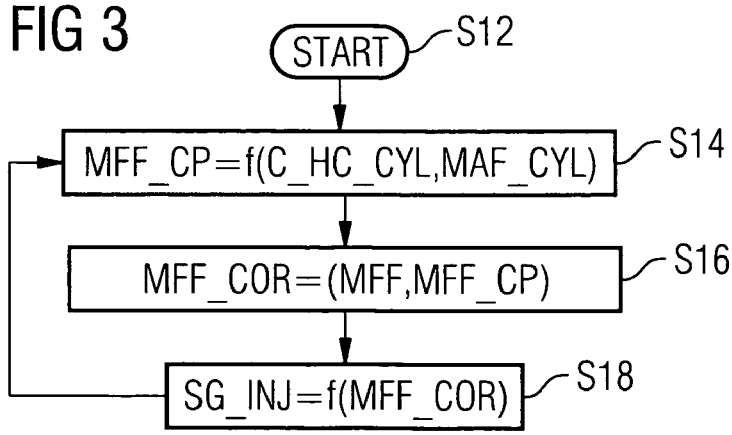
FIG. 3 shows a flow diagram of a second program, which is processed in the control device

A program according to FIG. 3 is started in a step S12 at a time close to a time when the engine starts. In a step S14 the cylinder tank purging fuel mass MFF_CP is determined as a function of the cylinder tank purging value C_HC_CYL and the air mass flow MAF_CYL into the combustion chamber of the respective cylinder Z1 to Z4. Such a determination is preferably carried out when the characteristic quantity is a tank purging fuel mass concentration. The air mass flow MAF_CYL can for example be determined by means of an intake pipe model known for such purpose to the person skilled in the art as a function of operating variables of the internal combustion engine.

The cylinder tank purging value C_HC_CYL can be determined directly in step S8. Alternatively however a further ring store can be provided with corresponding write and read pointers, by means of which, if the recirculation inlet 15 is not in direct proximity to the inlet into the engine block 2 of the cylinder Z1 to Z4, the gas runtime in the other components of the intake duct 1 can be modeled according to the procedure in FIG. 2. Such components can for example be the manifold 7 or even a charging air cooler depending on the arrangement.

In a step S16 a fuel mass MFF to be measured in, already predetermined as a function of the current load of the internal combustion engine by another functionality of the control device 36, which is to be measured in for each cylinder segment duration, is corrected appropriately as a function of the currently relevant cylinder tank purging fuel mass MFF_CPR, thereby determining a corrected fuel mass MFF_COR to be measured in. Such correction can for example take place as the predetermination of a predetermined air/fuel ratio in the combustion chamber before combustion of the mixture.

The cylinder segment duration is the time period required for a working cycle, divided by the number of cylinders Z1 to Z4 in the internal combustion engine. In the case of a four-stroke internal combustion engine with four cylinders for example, the cylinder segment duration therefore results from the inverse of half the rotation speed divided by the number of cylinders in the internal combustion engine.

In a step S18 the corresponding actuating signal SG_INJ to activate the respective injection valve 34 of the respective cylinder Z1 to Z4 is determined as a function of the corrected fuel mass MFF_COR to be measured in. The respective injection valve 34 is then activated according to the actuating signal SG_INJ. Processing then continues again in step S14, in some instances after a predeterminable waiting period or a predeterminable waiting crankshaft angle.

A program, by means of which the dynamic physical model of the recirculation path 14 is obtained, is started in a step S20 (see FIG. 4). In a step S22 variables can be initialized, thus a third write pointer IDX_WR_3 and a recirculation ring store BUF_2 are initialized. The recirculation ring store BUF_2 has storage locations for storing the recirculation tank purging values C_HC_BP_IN, which are then read from the recirculation ring store BUF_2 again as recirculation tank purging values C_HC_BP_OUT flowing through the recirculation outlet.

In a step S24 the recirculation tank purging value C_HC_BP_IN is determined for the characteristic quantity, which is representative of the tank purging fuel mass, which flows into the recirculation path on the inlet side in each instance during the predetermined time period. The recirculation tank purging value C_HC_BP_IN is preferably determined by means of a third function $f_3$, as a function of the output main path tank purging value C_HC_1_OUT, the air mass flow MAF, the intake pipe pressure MAP and the opening angle BDK of the recirculation control element 18. To this end the third function is determined in a correspondingly appropriate manner beforehand by means of corresponding experimentation on an engine test bed or even by simulation and is stored like the other functions $f_1$ to $f_4$ in a data store of the control device 36.

In a step S26 it is checked whether the opening angle BDK of the recirculation control element 18 is greater than zero, in other words the recirculation control element 18 is outside its closed position and therefore fluid can flow through the recirculation path from the recirculation inlet 15 to the recirculation outlet 16 and from there into the main path 9. If the condition in step S26 is not satisfied, processing resumes in step S24, in some instances after a predeterminable waiting period.

If however the condition in step S26 is satisfied, in a step S28 the value of the third write pointer IDX_WR_3 minus a value, which is determined by means of a fourth function f4 as a function of the air mass flow MAF, the intake pipe pressure MAP and the opening angle BDK of the recirculation control element 18, is assigned to a second read pointer IDX_RD_2. The fourth function is similarly determined in an appropriate manner by experimentation on an engine test bed or by simulation, such that the second read pointer IDX_RD_2 points in each instance to a storage location of the recirculation ring store BUF_2, the storage content of which is currently representative in each instance of the tank purging fuel mass flowing through the recirculation outlet.

In step S28 the content of the recirculation ring store BUF_2 at the position, to which the second read pointer IDX_RD_2 points, is then assigned to the recirculation tank purging value C_HC_BP_OUT flowing through the recirculation outlet.

The recirculation tank purging value C_HC_BP_OUT determined in step S24 is stored in the recirculation ring store BUF_2, at a position predetermined by the third write pointer IDX_WR_3.

In a step S30 the third write pointer IDX_WR_3 is incremented, preferably by the value one. After step S30 processing resumes in a step S24, preferably such that steps S24 to S30 are processed respectively once for each predetermined time period, particularly in respect of the capturing of associated measured values.

As an alternative to the procedure in respect of the main path ring store BUF_1 and the recirculation ring store BUF_2, corresponding characteristic curves or another physical model can also be provided.

The first function $f_1$ can alternatively also be a function of the air mass flow MAF into the intake duct 1 and the further intake pipe pressure. The same also applies to the second function $f_2$.

The third function $f_3$ can alternatively also be a function of the air mass flow MAF_CYL into the respective combustion chamber instead of the air mass flow MAF. The third function $f_3$ can alternatively also be a function of the further intake pipe pressure instead of the intake pipe pressure MAP. The same applies to the fourth function $f_4$ as to the third function $f_4$. A combination of the operating variables mentioned is also possible for the third and fourth functions. The dependency that is most favorable can be a function of the specific arrangement of the recirculation control element 18 within the recirculation path 14.

The invention claimed is:

1. A method for operating an internal combustion engine having a cylinder and an intake duct with a main path that opens into an inlet of the cylinder, comprising:

configuring a tank purging valve to control initiation of a tank purging flow into the intake duct at an inlet point upstream of the respective inlet of the cylinder;

configuring a recirculation path in parallel with the main path where the recirculation path has:

a recirculation inlet arranged in the main path, a recirculation control element arranged in the recirculation path that controls the opening of the recirculation path, and a recirculation outlet arranged into the main path upstream of the recirculation inlet; and determining a cylinder tank purging fuel mass that flows into a cylinder during the working cycle of the cylinder to a previous measuring in of fuel, where the cylinder tank purging fuel mass is determined as a function of an opening angle of the tank purging valve and an opening angle of the recirculation control element.

2. The method as claimed in claim 1, wherein the cylinder tank purging fuel mass is determined by a dynamic physical model of the recirculation path.

3. The method as claimed in claim 2, wherein the dynamic physical model comprises:

a recirculation ring store for storing a recirculation tank purging values representative of a tank purging fuel mass that flows into the recirculation path on the inlet side during a predetermined time period, the recirculation tank purging values are determined for storage in the recirculation ring store as a function of the opening angle of the recirculation control element and an output main path tank purging value that is representative of a tank purging fuel mass that flows to the recirculation inlet in the main path during the predetermined time period, and determining a recirculation tank purging value flowing through the recirculation outlet as a function of the opening angle of the recirculation control element from the recirculation ring store.

4. The method as claimed in claim 2, wherein the internal combustion engine comprises a plurality of cylinders, each cylinder having a cylinder inlet connected to the intake duct.

5. A device for operating an internal combustion engine having an intake duct connected to a cylinder inlet, a tank purging valve configured to control an initiation of a tank purging flow into the intake duct, the tank purging valve arranged at an inlet point upstream of the cylinder inlet, a main path arranged in the intake duct and a recirculation path arranged parallel to the main path and configured with a recirculation control element, a recirculation inlet. from the main path into the recirculation path and a recirculation outlet from the recirculation path into the main path where the recirculation outlet is disposed in the main path upstream in relation to the recirculation inlet, comprising:

a first cylinder tank purging fuel mass determining device that determines a cylinder tank purging fuel mass that flows into the cylinder during the working cycle of the cylinder to a previous measuring in of fuel; and a second cylinder tank purging fuel mass determining device that determines a cylinder tank purging fuel mass as a function of an opening angle of the tank purging valve and an opening angle of the recirculation control element.

6. The device as claimed in claim 5, wherein the cylinder tank purging fuel mass is determined by a dynamic physical model of the recirculation path.

7. The device as claimed in claim 6, wherein the dynamic physical model comprises:

a recirculation ring store for recirculation tank purging values representative of a tank purging fuel mass that flows into the recirculation path on the inlet side during a predetermined time period, the recirculation tank purging values are determined for storage in the recirculation ring store as a function of the opening angle of the recirculation control element and an output main path tank purging value that is representative of a tank purging fuel mass that flows to the recirculation inlet in the main path during the predetermined time period, and determining a recirculation tank purging value flowing through the recirculation outlet as a function of the opening angle of the recirculation control element from the recirculation ring store.

8. The method as claimed in claim 6, wherein the internal combustion engine comprises a plurality of cylinders, each cylinder having a cylinder inlet connected to the intake duct.

9. An internal combustion engine system, comprising:

a block having a cylinder;

a crank shaft rotably mounted in the block;

a piston arranged in the cylinder of the block;

a cylinder head arranged on the block;

a cylinder inlet arranged in the cylinder head;

an intake duct connected to the cylinder inlet having a main path that inlets an inlet flow into the cylinder;

a tank purging valve arranged at an inlet point upstream of the cylinder inlet the tank purging valve configured to control an initiation of a tank purging flow into the intake duct;

a recirculation path arranged parallel to the main path and configured with:

a recirculation inlet arranged at a union of the recirculation path and the main path, a recirculation control element arranged in the recirculation path that controls the opening of the recirculation path, and a recirculation outlet arranged at a union of the recirculation path and the main path upstream relative to the recirculation inlet;

a first cylinder tank purging fuel mass determining device that determines a cylinder tank purging fuel mass that flows into the cylinder during the working cycle of the cylinder to a previous measuring in of fuel; and a second cylinder tank purging fuel mass determining device that determines a cylinder tank purging fuel mass as a function of an opening angle of the tank purging valve and an opening angle of the recirculation control element.

10. The system as claimed in claim 9, wherein the internal combustion engine comprises a plurality of cylinders, each cylinder having a cylinder inlet connected to the intake duct.

11. The system as claimed in claim 9, wherein the cylinder tank purging fuel mass is determined by a dynamic physical model of the recirculation path.

12. The device as claimed in claim 11, wherein the dynamic physical model comprises:

a recirculation ring store for recirculation tank purging values representative of a tank purging fuel mass that flows into the recirculation path on the inlet side during a predetermined time period, the recirculation tank purging values are determined for storage in the recirculation ring store as a function of the opening angle of the recirculation control element and an output main path tank purging value that is representative of a tank purging fuel mass that flows to the recirculation inlet in the main path during the predetermined time period, and determining a recirculation tank purging value flowing through the recirculation outlet as a function of the opening angle of the recirculation control element from the recirculation ring store.

* * * * *